US005483710A

United States Patent [19]

Chan

[11] Patent Number: 5,483,710

[45] Date of Patent: Jan. 16, 1996

[54] JOINT FOR THE TOP RAILS OF A FOLDABLE BABY CRIB

[76] Inventor: Te-Erh Chan, 9th Fl., 49, Chung Ching S. Rd., Sec. 1, Taipei, 100, Taiwan

[21] Appl. No.: 179,870

[22] Filed: Jan. 11, 1994

[51] Int. Cl.[6] ..... A47D 13/06

[52] U.S. Cl. ..... 5/99.1; 16/325; 16/326; 403/102; 403/218

[58] Field of Search ..... 403/218, 100, 403/101, 102; 16/325, 326, 332, 335, 336, 327, 270; 5/99.1, 111, 114, 93.2

[56] References Cited

U.S. PATENT DOCUMENTS

| | | | |
|---|---|---|---|
| 3,655,297 | 4/1972 | Bolen, Jr. et al. | 403/100 X |
| 4,008,499 | 2/1977 | Wren, Jr. et al. | 5/99.1 |
| 4,044,411 | 8/1977 | Peterson | 190/2 X |
| 4,069,524 | 1/1978 | Carlo | 5/99.1 |
| 4,070,716 | 1/1978 | Satt et al. | 5/99.1 |
| 4,357,735 | 11/1982 | Saint et al. | 403/117 X |
| 4,376,318 | 3/1983 | Cirillo | 5/114 X |
| 4,538,309 | 9/1985 | Gunter | 403/174 X |
| 4,573,224 | 3/1986 | Saint | 5/99.1 |
| 4,688,280 | 8/1987 | Kohus et al. | 5/99.1 |
| 4,703,525 | 11/1987 | Shamie | 5/99.1 |
| 4,811,437 | 3/1989 | Dillner et al. | 5/99.1 |
| 5,195,551 | 3/1993 | Ju | 403/101 X |
| 5,293,656 | 3/1994 | Chan | 16/325 X |
| 5,353,451 | 10/1994 | Hsiung | 5/99.1 |

*Primary Examiner*—Dave W. Arola
*Assistant Examiner*—Christopher J. Novosad
*Attorney, Agent, or Firm*—W. Wayne Liauh

[57] ABSTRACT

A foldable baby crib having a joint, which is located at the center of each top rail of the foldable baby crib, is disclosed. The joint consists of a cover, which pivotally connects the inner ends of the two round tubes of the top rail; a fixed member, which is received and centered within the cover by means of pins; and a movable member, which is movably hung on a fixed shaft of the fixed member. The fixed member has two spring wings with elongated through hole provided on the ears thereof for allowing the pins to pass therethrough and thereby fix the fixed member to the cover. When the two round tubes of the top rail are extended to become a straight line, the pins passing through the ears are extend into a space just below the inner ends of the two round tubes so as to support the same. The movable member has two inner inclined ribs which, when the moveable member is pushed upward, force the lower ends of the spring wings of the fixed member to shift inward and bring the pins to separate from the inner ends of the two round tubes, and, at this point, depressing the cover will cause the top rail to be folded at the joint.

1 Claim, 9 Drawing Sheets

JOINT FOR THE TOP RAILS OF A FOLDABLE BABY CRIB

BACKGROUND OF THE INVENTION

To form a foldable baby crib, the frames thereof must be foldable. And, to fold the baby crib to the smallest volume possible, both the top rails of the frames and the lower floor supporting arms thereof must be foldable. Baby cribs with foldable top rails are disclosed in U.S. Pat. Nos. 4,357,735, 4,070,716, 4,044,411, 4,573,224, 4,376,318, 4,069,524, and 4,811,437. Baby cribs with foldable floor supporting arms are disclosed in U.S. Pat. Nos. 4,703,525, 4,538,309, 4,008, 499, 4,688,280, and 4,811,437.

Among the above patents, the U.S. Pat. No. 4,811,437 discloses a baby crib having both foldable top rails and foldable floor supporting arms. Taiwan Patent Application Ser. No. 81208167, which has been published now, also discloses a baby crib having both foldable top rails and foldable floor supporting arms. These two cases have, however, the following drawbacks:

1. The foldable top frame thereof consists of numerous parts or components and therefore have complicated assembling procedures and increased manufacturing cost; and 2. The floor supporting arms thereof include six tubes radially extending from a central hub member. However, the floor of the baby crib consists of four discrete but connected panels, and there are two L-shaped supporting legs included in the floor supporting arms which are disposed at a central junction of the floor panels and therefore cannot properly provide support to the crib floor to give enough safety when in use.

SUMMARY OF THE INVENTION

It is therefore a primary object of the present invention to provide a joint for the top rails of a foldable baby crib. Each of the top rails of the baby crib according to the present invention consists of two tubes pivotally connected at their inner end to a central joint, and at the other outer end to a vertical post forming a corner of the baby crib. At the central joint, the two tubes of the top rail can be folded or be extended.

The joint for the top rails of a foldable baby crib according to the present invention mainly consists of a cover, a fixed member, and a movable member. The cover pivotally connects at its two lateral ends to two tubes which together form a top rail. The attached member is fixed to a central portion inside the cover, and the movable member is movably attached to a middle fixed shaft of the fixed member. The fixed member has two spring wings forming its two sides. The spring wings are so designed that each of them has outward projected ears each having a through hole therein for a pin to pass through. When the two tubes of the top rail are extended straight, their inner ends inside the cover are stopped and supported by the two pins passing through the projected ears of the fixed member so that they are kept in a horizontal state. The movable member may be positioned upward or downward relative to the fixed member and thereby forces two lower ends of the spring wings of the fixed member to shift inward towards each other. At this point, the two pins passing through the ears oh the wings are brought inward to finally separate from the inner ends of the two horizontal tubes of the top rail. When the cover of the joint is pushed downward at this time, the whole top rail is folded at the joint and the two lateral tubes are driven to pivotally turn relative to the joint with their outer ends pointing upward.

DETAILED DESCRIPTION OF THE PREFERRED EMBODIMENTS

Figure 1:
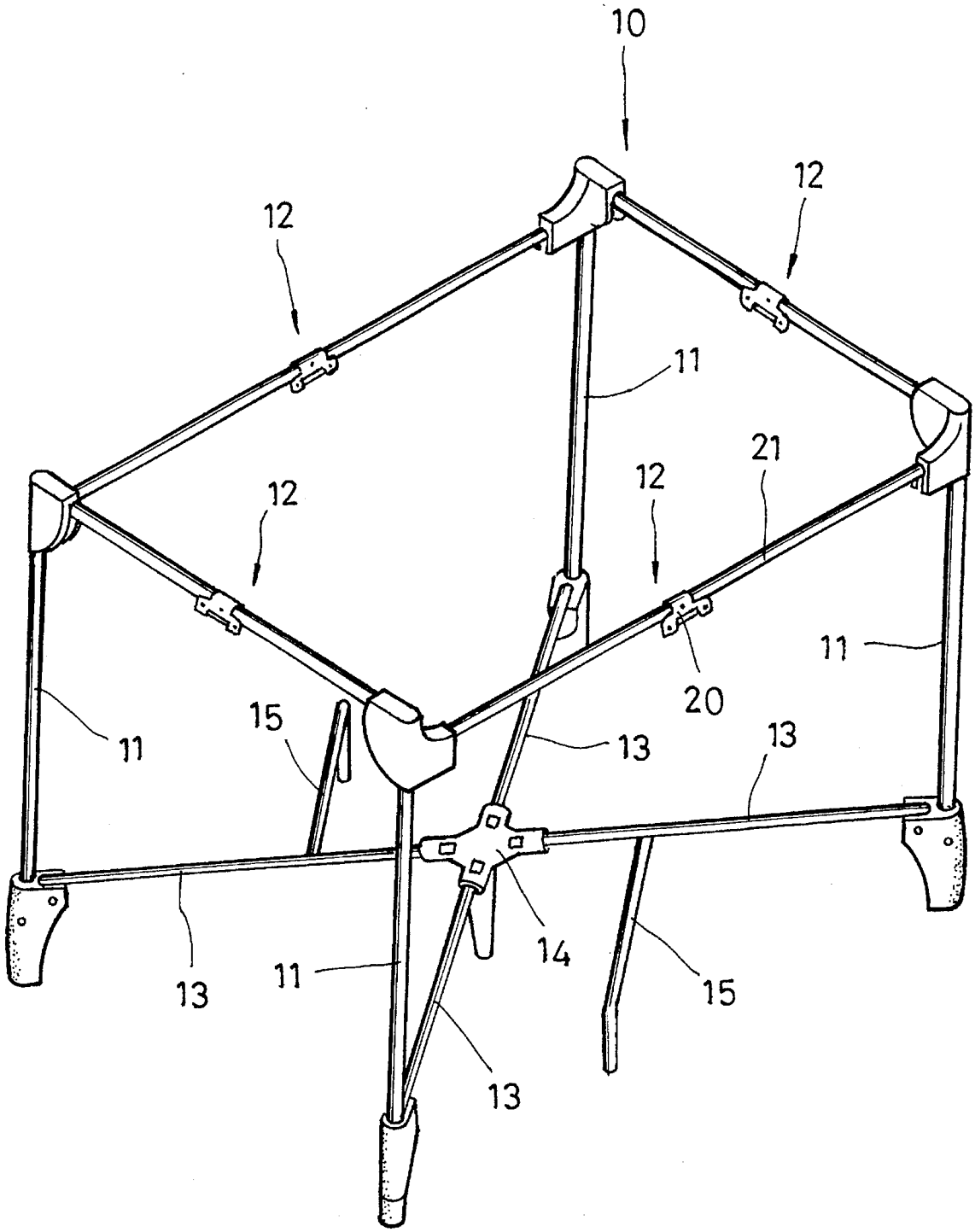
FIG. 1 is the frame of a foldable baby crib according to the present invention in an erected state.

Please refer to FIG. 1. A foldable baby crib 10 has a frame which includes four vertical corner posts 11 of which a lower end is fixedly received within a first connecting member and an upper end is fixedly received within a second connecting member, four horizontal top rails 12 of which two ends are pivotably received within the second connecting means, four horizontal arms 13 each pivotably coupled at an inner end thereof to a central hub member 14 and pivotably coupled at an outer end thereof to one of the first connecting members at the lower end of the vertical corner posts 11. The horizontal top rails 12 each consists of two round tubes 21 and a central joint 20 of which two lateral ends are pivotally connected to an inner end of the round tubes 21. The two round tubes 21 are separately pivotably received at their outer ends, and also the two ends of the top rail 12, within the second connecting members.

Figure 2:
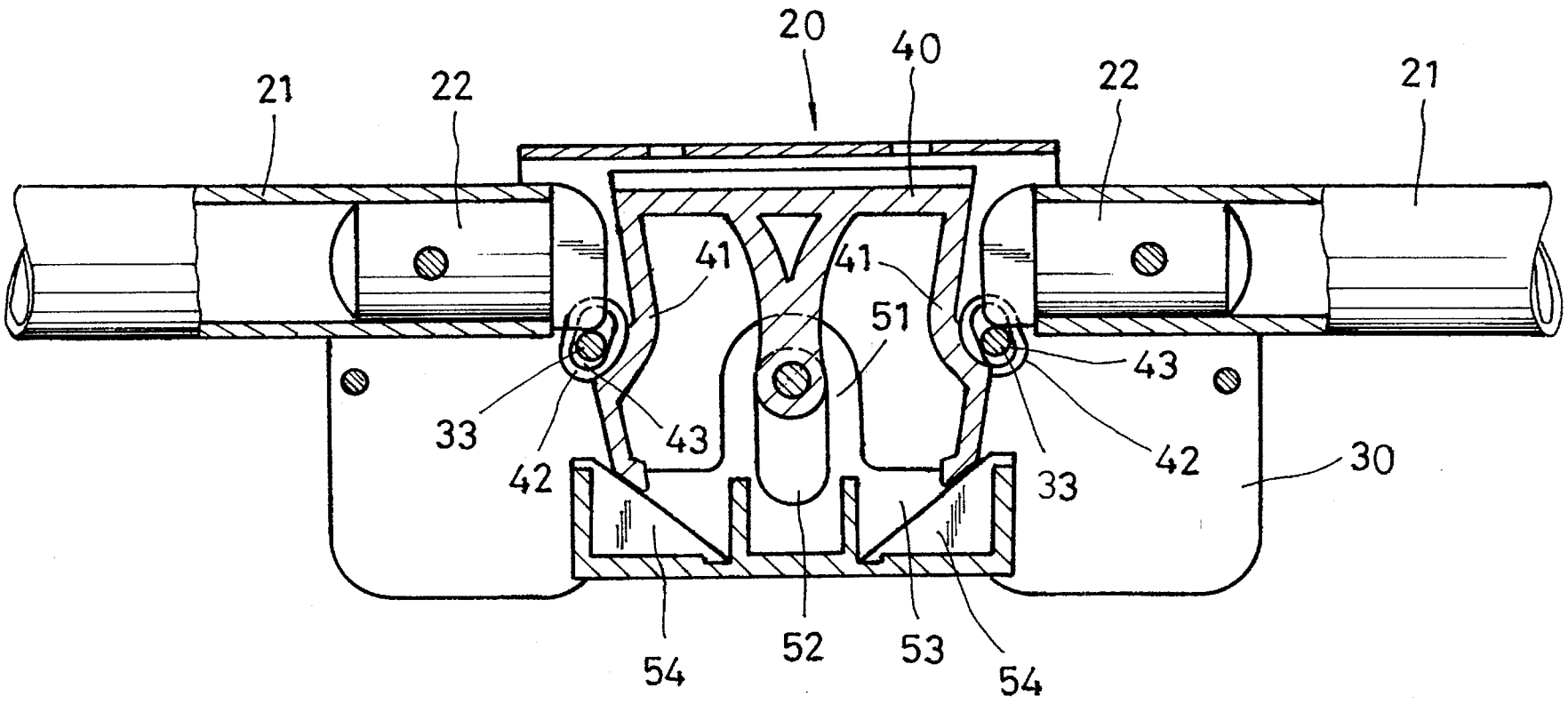
FIG. 2 is an exploded perspective of the top rail joint according to the present invention.
Figure 3:
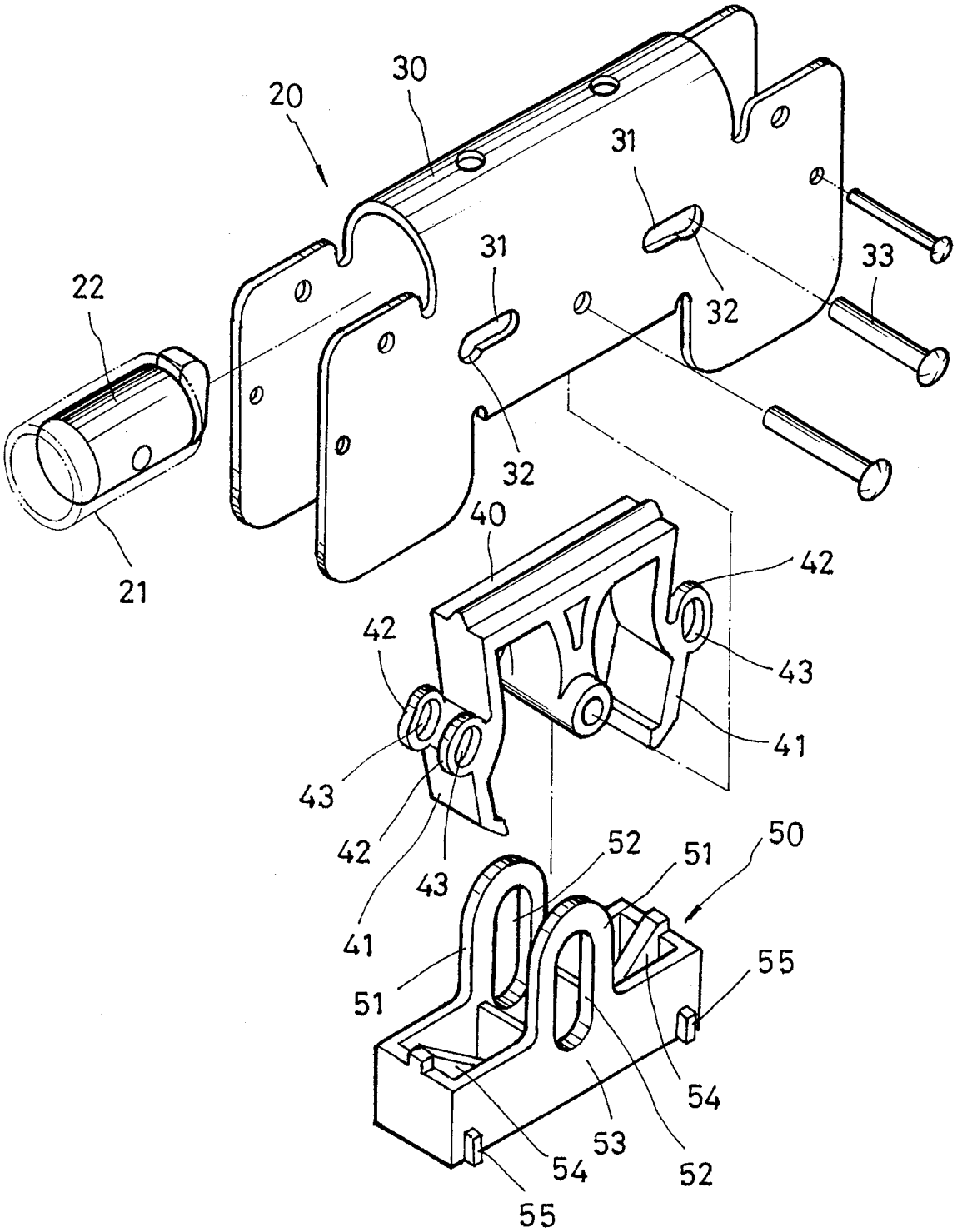
FIG. 3 is a sectional view of the top rail joint showing the top rail is in an extended straight state.

With reference to FIGS. 2 and 3, the central joint 20 consists of a cover 30, a fixed member 40, and movable member 50.

The cover 30 has a first face and a second face which together give the cover 30 a substantially n-shaped cross section. The cover 30 pivotably receives within two lateral ends thereof the inner ends of the two round tubes 21 and fixedly receives the fixed member 40 inside it by means of pins. Two horizontally extended long holes 31 are laterally symmetrically formed on each face of the cover 30 at predetermined positions. Each of the long holes 31 has an outer end which slightly extends downward and forms a recess 32.

The fixed member 40 has two downward extended spring wings 41 at two lateral sides thereof. Each of the spring wings 41 is provided on an outer surface thereof ears 42 with enlongated through hole 43, at a height corresponding to the long holes 31 of the cover 30, and a lower end which is an inward and downward inclined plane. The fixed member 40 is centrally and fixedly positioned between the first and the second faces of the cover 30 by means of pins. Two of these pins, which are given the numeral reference number of 33, are passed through the long holes 31 of the cover 30 and the through holes 43 of the ears 42 of the fixed member 40. When the spring wings 41 are subjected to force and shift inward towards each other, the pins 33 passing through the ears 42 are allowed to translate within the long holes 31.

The movable member 50 has a box-like lower portion 53 inside which two lateral ribs 54 each having an inward and downward inclined top surface are formed, and an upper portion which includes two vertically extended loops 51 with central elongate holes 52 therein, so that the movable member 50 is attached to the fixed member 40 by hanging the loops 51 on a central fixed shaft of the fixed member 40.

An insert 22 is fixed in the inner end of each round tube 21 such that a predetermined length of the insert 22 projects out of the inner end of round tube 21. Moreover, the projected portion of the insert 22 has an upper rounded corner.

Figure 4:
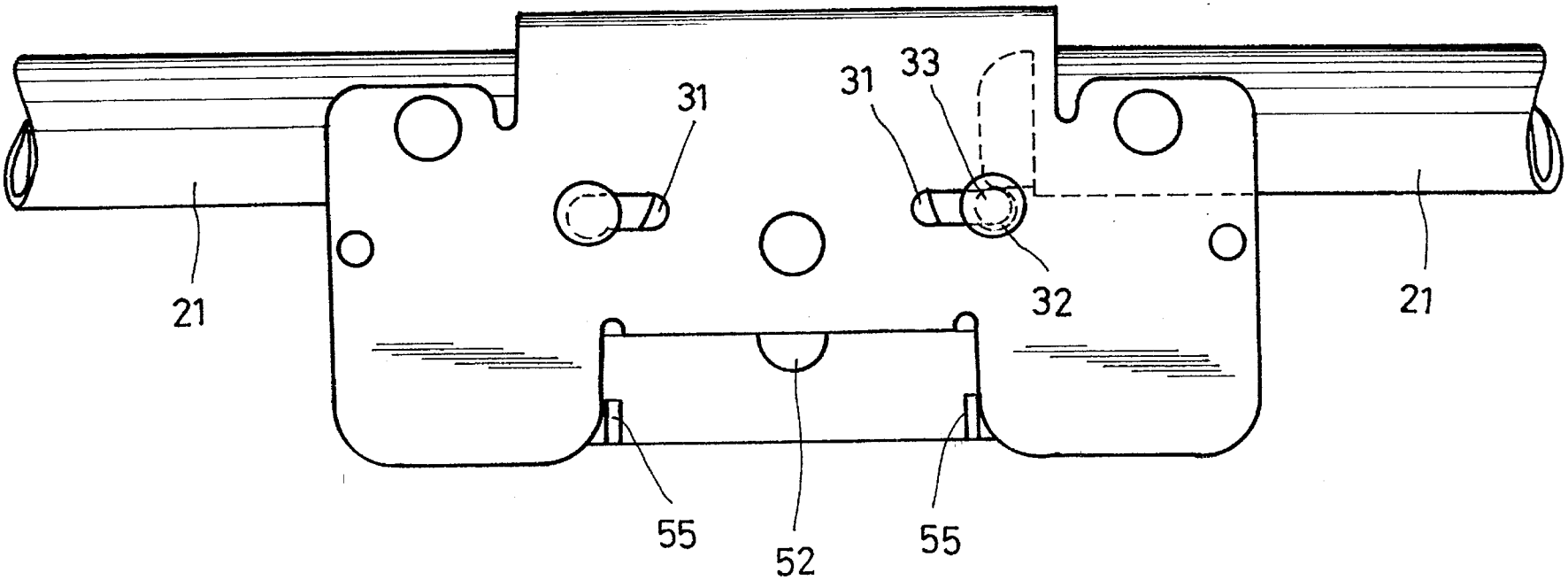
FIG. 4 is an elevational plan of the top rail joint of FIG. 3.

From FIGS. 3 and 4, it can be seen that two round tubes 21 connected by the top rail joint 20 are fully extended to a straight line. At this point, the pins 33 passing through the long holes 31 of the cover 30 and the through holes 43 of the fixed member 40 would extend into a space just below the projected portion of the inserts 22 and thereby support the two round tubes 21. When the cover 30 is subjected to any downward force, the pins 33 are accordingly forced into the recesses 32 of the long holes 31 to prevent any displacement within the horizontal long holes 31. By this method, a secure use of the joints on a foldable baby crib can thereby be achieved.

In the present invention, when the round tubes forming the top rails are fully extended in a straight state, the pins 33 are used as the bearing member which may withstand higher pressure. And, as described above, the pins 33 fall into the recesses 32 of the long holes 31 when they are subjected to downward force, therefore, the pins 33 will not be transversely moved and separate from the projected portions of the inserts 22 due to a downward force and, can be used as positioning members.

Figure 5:
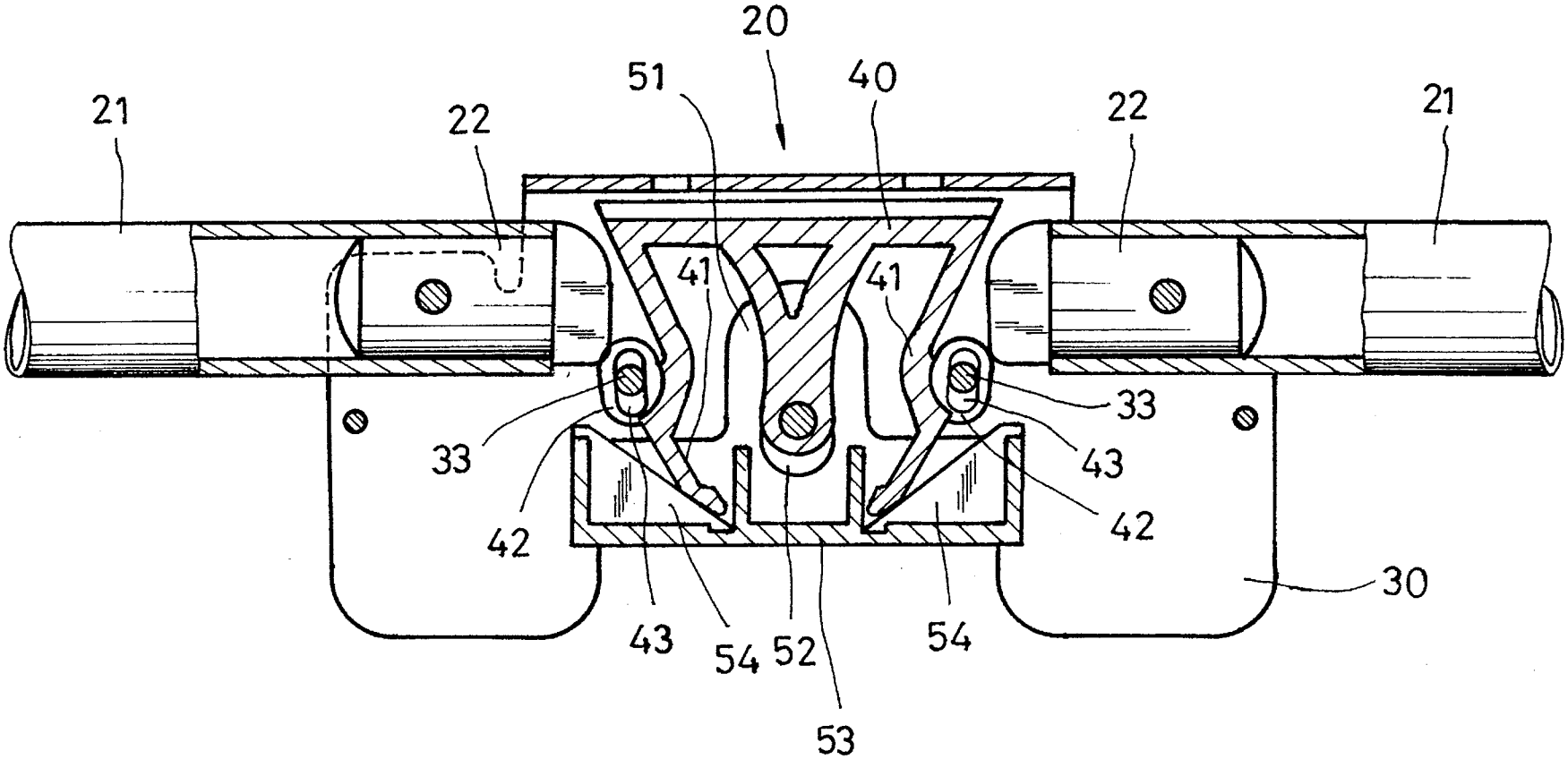
FIG. 5 is a sectional view of the top rail joint showing the spring wings of the fixed member at an inwardly shifted position.
Figure 6:
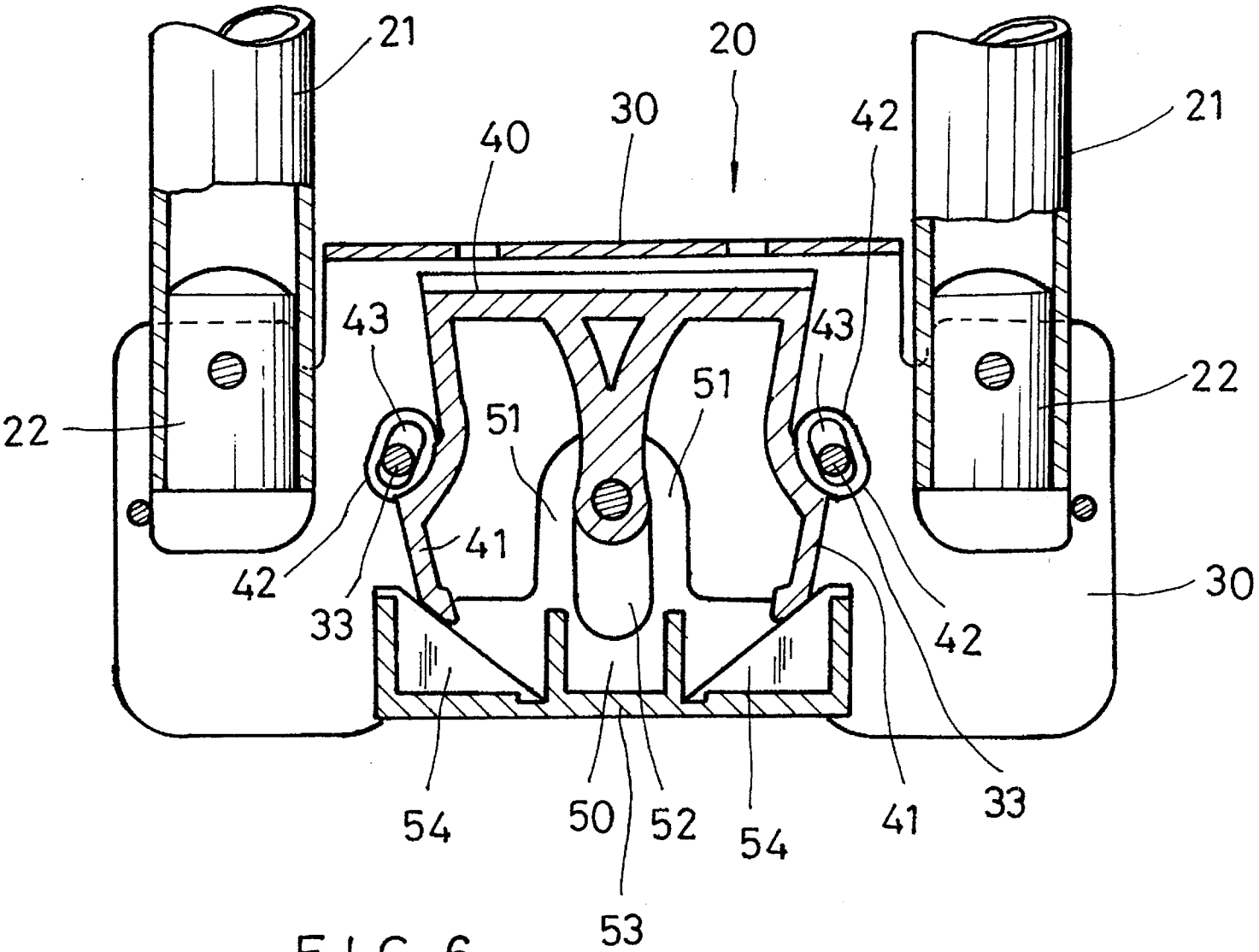
FIG. 6 is a sectional view showing the top rail has been folded at the joint of the present invention with its two lateral tubes pivotally turned upward.
Figure 7:
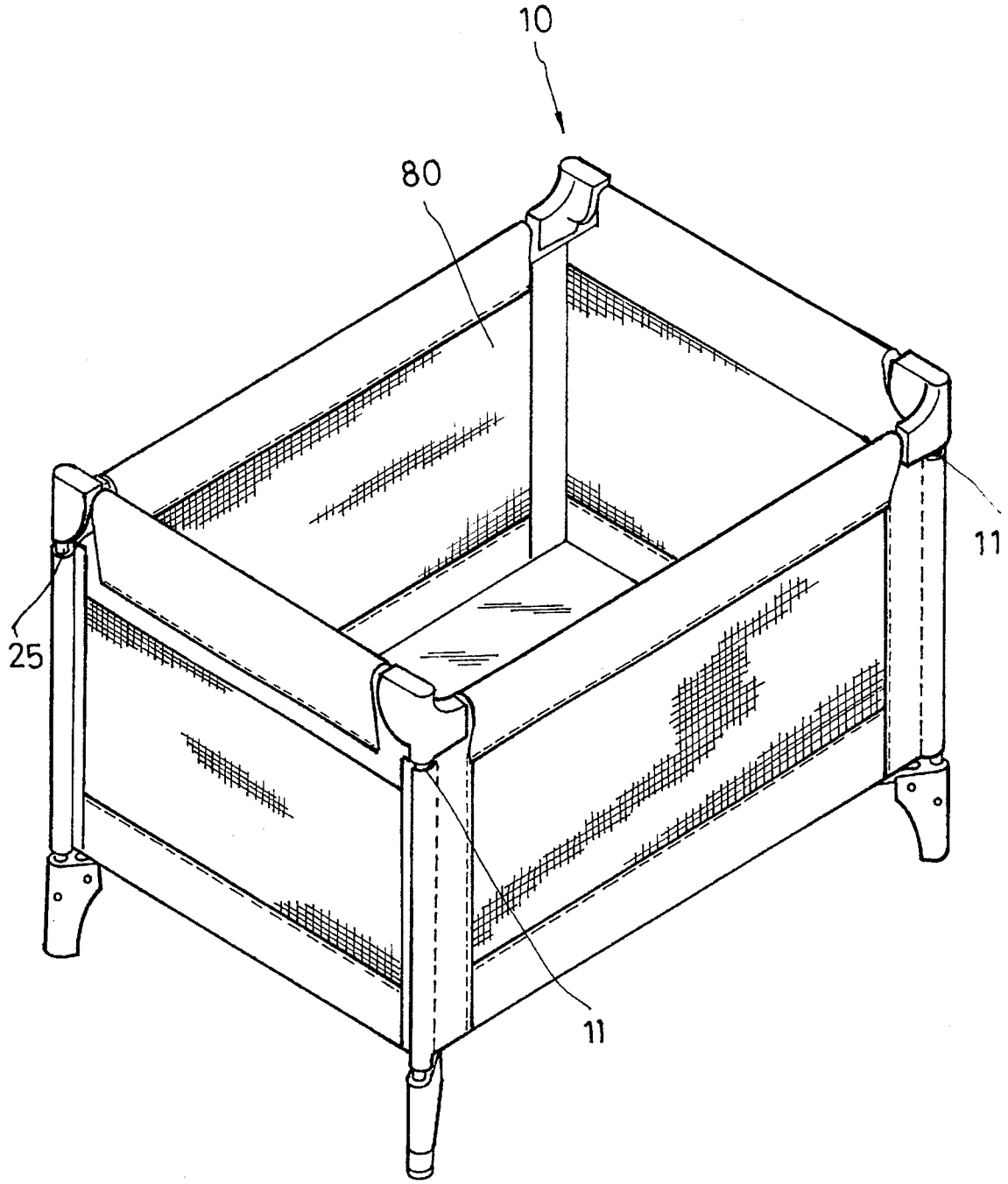
FIG. 7 is a perspective of a baby crib using the top rail joint of the present invention, on which detachable enclosures are attached to the frame of the baby crib.

When the movable member 50 is pushed upward, the inclined ribs 54 inside the movable member 50 would contact the two inward and downward inclined lower ends of the spring wings 41 of the fixed member 40, forcing the spring wings 41 to shift inward toward each other. This inward shifting of the spring wings 41 brings the pins 33 passing through the through holes 43 of the ears 42 on the outer surfaces of the spring wings 41 to move out of the recesses 32 and to translate toward the other end of the long holes 31 opposite to the recesses 32, and finally separate from the lower edge of the projected portion of the inserts 22 and the inner ends of the two round tubes 21, accordingly, as shown in FIG. 5. When the cover 30 is depressed at this point, the round tubes 22 would be pressed by the cover 30 to pivotally turn upward, and the top rail 12 is folded at the joint 20, as shown in FIG. 6.

The upward movement of the movable member 50 forces the two spring wings 41 to shift inward which slightly changes the horizontal position of the ears 42. However, since the through holes 43 are enlongated holes, this allows the holes 43 to shift along with the spring wings 41 without influencing the translation of the pins 33 within the horizontal long holes 31.

As shown in FIGS. 2 and 4, there are two vertical ribs 55 separately disposed at the side walls of the lower portion of the movable member 50 corresponding to the first and the second faces of the cover 30, so that the ribs 55 can guide the movable member 50 to be adjusted desirably within a route defined by the cover 30.

When the cover 30 is again pulled upward from its depressed position, the round upper corner of the projected portion of the inserts 22 in the inner ends of the round tubes 21 will automatically and smoothly push the spring wings 41 of the fixed member 40 inward, allowing the round tubes 21 to pivotally turn and return the folded top rail 12 to its fully extended and straight position.

Figure 8:
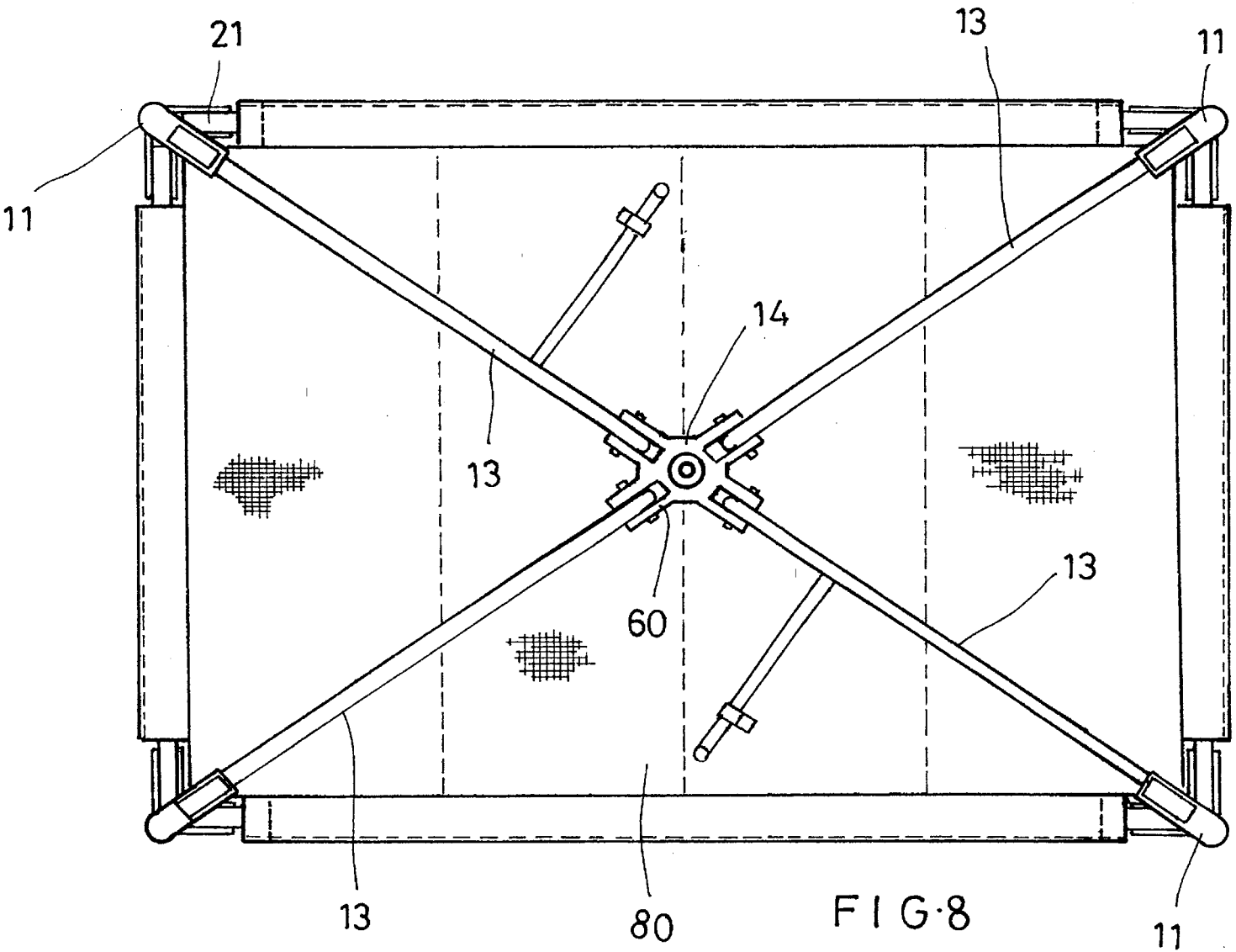
FIG. 8 is a bottom view of the baby crib of FIG. 7.

Please refer to FIG. 8, the central hub member 14 of the baby crib according to the present invention has four radially arranged connecting legs to separately pivotably connect the four horizontal arms 13 at their inner ends. Two L-shaped supporting legs 15 are separately pivotally connected to two opposing horizontal arms 13 in the same diagonal so that they may provide support to the central portion of floor panels 70 placed above the fabric enclosure 80 of the baby crib 10. Fastening straps 81 are provided at a bottom outer surface of the fabric enclosure 80 for locating the L-shaped supporting legs 15 at the correct positions when the frame of the baby crib 110 is fully spread or for fastening the L-shaped supporting legs 15 to the radially extended arms 13 to which they pivotally connected when the frame is collapsed.

Figure 10:
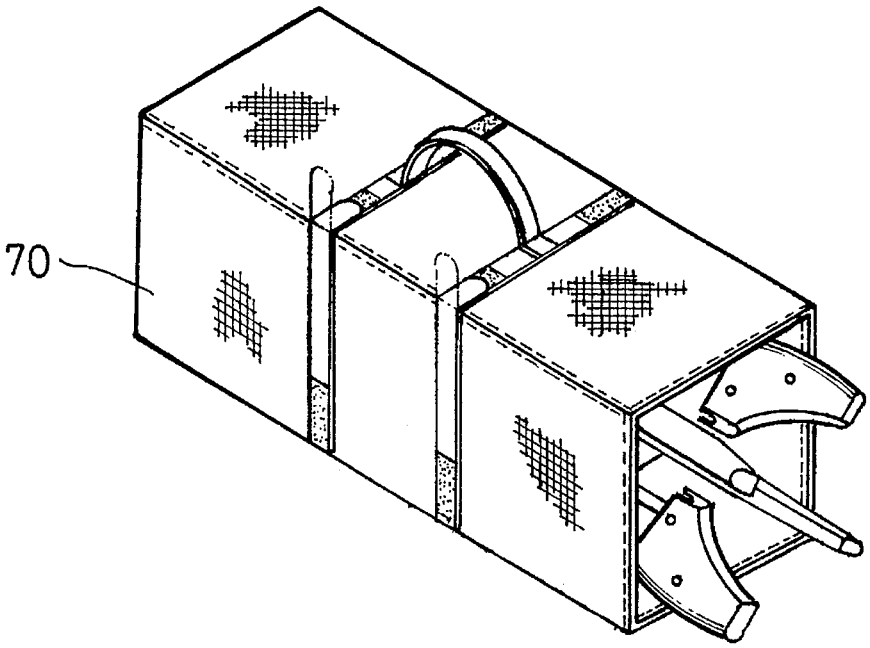
FIG. 10 is a perspective of the foldable baby crib in a folded position, housed within a carrying case formed by the folded floor.
Figure 9:
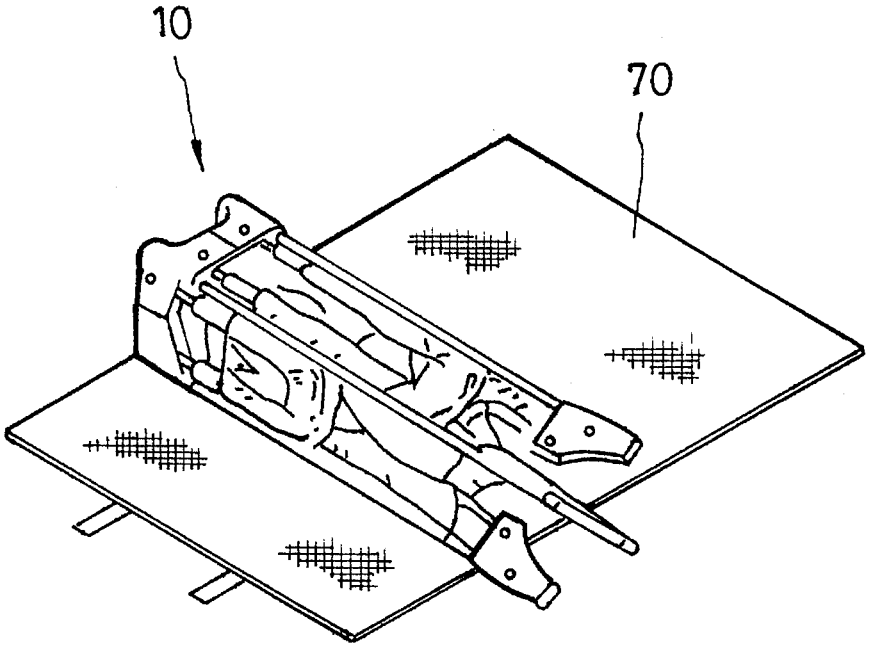
FIG. 9 is a perspective of the folded baby crib with the foldable floor unfolded.

The foldable baby crib 10 according to the present invention may be collapsed as shown in FIG. 9, and then, the collapsed baby crib can be wrapped within the discrete but connected floor panels 70, as shown in FIG. 10.

With the top rail joint for a foldable baby crib of the present invention, fewer components are needed, both the operation and the assembly thereof are simple, and the manufacture cost can be reduced, accordingly. Above all, the joint of the present invention has increased structural and supporting strength which enhances the safety of a foldable baby crib in use.

What is claimed is:

1. A foldable baby crib including a joint for top rails, said foldable baby crib having a frame consisting of four vertical corner posts, a lower end of each vertical corner post is fixedly received within a first connecting member and an upper end of each vertical corner post is fixedly received within a second connecting member, four horizontal top rails, two ends of each horizontal top rail are pivotably received within the second connecting member, four horizontal arms each pivotably coupled at an inner end thereof to a central hub member and pivotably coupled at an outer end thereof to one of the first connecting members at the lower end of the vertical corner posts; said horizontal top rails each consisting of two round tubes which pivotally connect at an inner end thereof to two outer ends of said joint, and at their outer ends, which are also said two ends of said horizontal top rail, to said second connecting members; said joint each comprising a cover, a fixed member, and movable member;

said cover having a first face and a second face which together give said cover a substantially n-shaped cross section, and pivotably receiving within two lateral ends thereof said inner ends of said two round tubes and fixedly receiving said fixed member inside said cover by means of pins; two horizontally extended long holes being laterally symmetrically formed on each face of said cover at predetermined positions and each having a slightly downward extended outer end which forms a recess;

said fixed member having two downward extended spring wings at two lateral sides thereof, each of said spring wings being provided on an outer surface thereof ears with each ear having an elongated through hole, at a height corresponding to said long holes of said cover, and a lower end which is an inward and downward inclined plane said fixed member being centrally and fixedly positioned between said first and said second faces of said cover by means of pins; two of said pins passing through said long holes of said cover and said through holes of said ears of said fixed member, such that when said spring wings are subjected to force and shift inward toward each other, said two pins passing through the ears are allowed to translate within said long holes of said cover;

said movable member having a box-like lower portion inside which two lateral ribs each having an inward and downward inclined top surface being formed, and an upper portion which includes two vertically extended loops with central elongated holes therein so that said movable member is attached to said fixed member by hanging said loops on a central fixed shaft of said fixed member said round tubes each having an insert fixed in said inner end thereof such that a predetermined length of said insert projects out of said inner end of said round tube; said projected length of said insert having an upper rounded corner:

said pins which pass through said long holes of said cover and said through holes of said fixed member extending into a space just below said projected length of said inserts and locating in said recesses of said long holes of said cover when said two round tubes are fully extended to a straight line and said inclined ribs of said movable member, at the time said movable member is pushed upward, being brought to contact said two inward and downward inclined lower ends of said spring wings of said fixed member, forcing said spring wings to shift inward toward each other and thereby bringing said two pins passing through said ears of said spring wings to move out of said recesses and to translate toward an inner end of said long holes and finally separate from said projected length of said inserts, permitting said top rail to be folded at said joint.

* * * * *